United States Patent [19]

Levinos

[11] 3,975,243

[45] Aug. 17, 1976

[54] ELECTROLYTICALLY INDUCED POLYMERIZATION UTILIZING DIAZOTIZATION OF PRIMARY AROMATIC AMINES

[75] Inventor: Steven Levinos, Chatham, N.J.

[73] Assignee: Keuffel & Esser Company, Morristown, N.J.

[22] Filed: Sept. 4, 1975

[21] Appl. No.: 610,476

Related U.S. Application Data

[62] Division of Ser. No. 242,141, April 7, 1972.

[52] U.S. Cl. ..... 204/72; 96/35.1; 204/18 PC

[51] Int. Cl.[2] ..... C25B 3/00; B44C 1/04

[58] Field of Search ..... 204/72, 18 PC; 96/1 R, 96/1.5, 35.1, 75, 49, 91 R

[56] References Cited

UNITED STATES PATENTS

| | | | |
|---|---|---|---|
| 2,306,471 | 12/1942 | Solomon | 96/91 R |
| 3,409,431 | 11/1968 | Deutsch | 204/18 PC |
| 3,436,215 | 4/1969 | Levinos et al. | 96/35.1 |
| 3,600,173 | 8/1971 | Levinos et al. | 96/1 R |

*Primary Examiner*—T. M. Tufariello
*Attorney, Agent, or Firm*—Lionel N. White

[57] ABSTRACT

Material useful in electropolymerization processes comprises a conductive support and a layer thereon of a composition comprising a polymerizable monomer and polymerization catalyst precursor which is a combination of an alkali metal nitrite and a primary aromatic amine. Electrolysis of the composition results in diazotization of the amine with subsequent electrolytic generation of polymerization-inducing free radicals. The anodic reaction ensures polymerization at and bonding of the resulting polymer to the support sheet of the material even when used in conjunction with zinc oxide photoconductor cathode layers. The material is particularly useful in negative-working imagery and in the preparation of patterned resist layers.

2 Claims, No Drawings

ELECTROLYTICALLY INDUCED POLYMERIZATION UTILIZING DIAZOTIZATION OF PRIMARY AROMATIC AMINES

This application is a division of co-pending application, Ser. No. 242,141, filed Apr. 7, 1972.

BACKGROUND OF THE INVENTION

Photoconductive layers have long been employed as a means for obtaining from a limited light exposure an image-wise pattern of conductivity which can be utilized in a number of electrolytic processes for generating visible, high-contrast, substantially permanent graphic images. Photoconductive layers have thus been employed, for example, in imaging methods which entail the electrolytic reaction of color formers to provide a visible image, as described in U.S. Pat. No. 2,764,693. As a means for providing the definitive image pattern of electrical conductivity, photoconductive layers have also been employed in electropolymerization methods as described in U.S. Pat. No. 3,600,173.

The present invention also involves electropolymerization of ethylenically unsaturated compounds, such as vinyl monomers, and in this respect is sufficiently closely related to the subject matter of the latter referenced patent that the disclosures and discussions there, particularly with respect to polymerizable monomers and photoconductive materials per se, will provide a significant and substantial description of the basis of the present invention.

The invention described in U.S. Pat. No. 3,600,173, while providing a useful means for obtaining images comprising polymerized vinyl materials, does have some notable drawbacks. A first and not the least of these disadvantages is the fact that the progenitor of polymerization-initiating free radicals present in the imaging material consists essentially of a light-sensitive diazonium compound. As a result of the inherent potential in the imaging material for decomposition of this essential element of the electropolymerization process, such materials must generally be handled under conditions which will ensure the minimum of degeneration of the free radical progenitor. For example, the materials must be stored in temperate conditions with the exclusion of light and, during use, safelight procedures must be observed.

An additional drawback, and one of greater significance, results from the fact that the electropolymerization procedures utilizing diazonium free radical progenitors involves a reaction which is cathodic by nature, as described in the referenced disclosure. This characteristic coupled with the inherent rectification properties of generally preferred photoconductor materials — zinc oxide, for example — results in the formation of polymer images at the interface between the photoconductor and the polymerizable composition of the imaging material.

While such a disposition of products of electrolysis at the photoconductor surface is not detrimental, and may even be preferable in the direct-imaging systems earlier noted and those additionally described, for example, in U.S. Pat. No. 3,010,883, the polymerization of monomeric ingredients at the surface farthest disposed from the carrier sheet of an imaging composition is far from advantageous. This result derives from the fact that polymerizable imaging compositions are employed, for the most part, in wash-off procedures where the polymerized matrix must be closely adhered to the support of the material while the unexposed and, thus, non-polymerized materials are removed from the carrier sheet by washing or the like.

SUMMARY

As noted in U.S. Pat. No. 3,600,173, the generation of polymerization-initiating catalyst species, presumably in the form of free radical entities, through electrolysis of diazonium compounds is primarily cathodic in nature. As a result, the formation of insoluble polymer products at the interface between the polymerizable layer and its support sheet, as is generally preferred in the imaging of products which are developed by wash-off removal of unpolymerized material, requires the formation of an electrolytic circuit wherein the conductive support sheet comprises the cathode. While such an arrangement may be readily prepared through the use of cadmium sulfide photoconductor layers, the more commonly available and widely utilized zinc oxide photoconductors find little practical utilization in these methods.

Due to the inherent rectification properties of zinc oxide photoconductor materials, it is not practical to utilize these compounds as the anode in electrolytic circuits, since the flow of current in such a circuit would be severely restricted. The present invention, however, provides a system of photoelectropolymerization which can utilize the desirable zinc oxide photoconductors in their most effective cathodic roles, yet can achieve polymerization at a support surface by providing an anodic polymerization reaction.

In accordance with the present invention, a conductive support is coated with a layer of a composition comprising a polymerizable vinyl monomer, an alkali metal nitrite and a primary aromatic amine. Combining the resulting sheet material in the usual manner with a zinc oxide photoconductor layer on a substantially transparent conductive support, and a source of electric current, yields a system of potential electrolysis which can be activated by exposure of the photoconductor to light, usually in the form of the image to be reproduced.

As the result of illumination, and thus the completion of the electrical circuit in the system, electrolysis of the imaging sheet composition causes a decrease in pH at the carrier anode with formation of nitrous acid and the diazotization of the primary amine to form a diazonium compound. Contrary to the procedures described in U.S. Pat. No. 3,600,173, the initial lack of a dissociable diazonium compound in the combination of the nitrite and amine compounds renders an acidic environment in the polymerizable composition unnecessary. Thus, sufficient alkali may be incorporated in the polymerizable layer to maintain a slight basicity which renders the generated diazonium compound susceptible under the conditions of electrolysis to proceed to the formation of polymerization-initiating species of catalyst, such as the noted diazoxy or phenyl free radicals.

Since the formation of diazonium compound is restricted to the immediate area of the carrier anode of the system, the formation of polymerization-initiating free radicals, and the resulting polymerization of the vinyl monomer, is concentrated at the interface between the imaging composition and its carrier sheet. Thus, from the very outset of polymerization there is formed the bond between the polymerized monomer and the carrier sheet which is so important in the formation and retention of images which rely for their development upon the removal of unpolymerized monomer composition. Permanently legible images and effective resist patterns may be generated in this manner with a minimum amount of polymerization and in a substantially shorter time with the materials and systems of the present invention. The anodic generation of polymer resulting from the use of the present materials eliminates the previous less desirable alternatives of polymerizing through the whole thickness of an imaging composition layer when using zinc oxide photoconductors and their required cathodic polymerization systems, or utilizing the more costly non-rectifying photoconductor layers.

DESCRIPTION

Polymerizable compounds, photoconductor materials, conductive substrates, binder resins, coating procedures, and the like described in U.S. Pat. No. 3,600,173 may likewise be used in the present invention. The numerous acrylic and other polymerizable vinyl compounds and monomers suggested there and elsewhere in the art, as well as the many noted cross-linking agents, may be similarly employed in the preparation of the present polymerizable compositions. Coating adjuncts may likewise be employed, as desired. For example, natural or synthetic film formers such as gelatin, polyvinyl alcohol, carboxymethyl cellulose, and the like may be employed. The use of such binders serves the usual purpose of maintaining homogeniety in the coating, with gelatin, in particular, providing an additional advantage by virtue of its capability of becoming involved in the formation of graft polymer and thus extending the resulting polymerization product.

Other components of the present systems which are common to electropolymerization systems; for example, the conductive supports for the polymerization composition as well as the photoconductor layer and its substantially transparent cathode base, may be any of the many types previously cited. Any of the numerous photoactive cathode components may be employed with equally good results.

It will thus be apparent that the substance of the present invention resides in the composition of the precursor of the polymerization-initiating free radical species. As generally noted above, the essential components of the precursor are a compound which is, or is capable of providing, a diazotizable primary aromatic amine, and an alkali metal nitrite. The diazotization reaction utilized in the present invention is commonly known and it has been determined that any of the numerous typical diazotizable primary aromatic amines may be employed in the preparation of the present materials. Thus, p-phenylenediamine, 2,5-dichloroaniline, p-aminobenzoic acid, p-nitroaniline, ethyl-p-aminobenzoate, aniline, benzidine, o-tolidine, p-aminophenol, o-aminophenol, p-bromaniline, p-aminoacetanilide, phenyl-p-phenylenediamine, o-aminobenzoic acid, p-aminoacetophenone, o-aminoacetophenone, m-aminoacetophenone, metanilic acid, sulfanilic acid, p-methoxy aniline, and p-aminosalicylic acid, and other similar amines may be employed with good results. Other compounds, such as isatoic anhydride which upon electrolysis provides diazotizable o-aminobenzoic acid, may likewise be used.

The rate of polymerization in the monomer-containing composition is generally dependent upon the rate of generation of the diazonium compound, and thus the polymer-initiating species; therefore, it is desirable to include in the composition the maximum practical amounts of primary amine and nitrite compounds. The limitation on the amounts of these polymerization species precursors is affected primarily by the compatibility of these compounds with the other components of the polymerizable composition. The noted use of binder adjuncts, particularly hydrophilic materials such as gelatin, enables greater proportions of the precursor compounds to be included in the composition. The molar ratio of nitrite compound to amine may be generally in the range of 1:1 with but slight excess of the nitrite compound, since it would appear that some bit of this material is utilized in the formation of nitrous acid which is initially expended in the neutralization of alkali in the neighborhood of the anode of the system.

Binder adjuncts exhibit also a pronounced effect upon the amount of monomer materials which may be incorporated into the polymerizable composition without a resulting crystallization of the monomer from the composition. Thus, the proportion of monomer in a polymerizable layer is limited only by compatibility tolerance with respect to additional materials in the composition and is in no way critical to the substance of the present invention. Blends of solid monomer with gelatin binder adjuncts have been found to be suitable with up to about 35% monomer content.

As with the previously referenced system utilizing diazonium compounds per se as the catalyst precursor, any of numerous available electrically conductive materials may be utilized as the base support for the polymerizable composition. Metal sheets of all varieties and papers and films bearing electrically conductive coatings, as well as such sheet materials having incorporated therein electrolytes or conductive pigments, may be employed.

An additional advantage, however, derives from the present invention in view of the fact that the involved polymerization-initiating reaction is anodic in character. As a result of the reaction taking place at the surface or in the general vicinity of the coating support rather than at the photoconductor surface as was common in previous processes, an additional catalytic effect of injected metal ions from the anode may be utilized in the polymerization process. It has been found, for example, that supports such as aluminum, iron and copper further promote or accelerate the polymerization of the monomer composition during the electropolymerization process. Thus, the present invention is particularly adapted to the formation of printing plates on the usual aluminum substrates, or for the preparation of printed circuits which normally involves the use of copper-surfaced materials.

PREFERRED EMBODIMENTS

The electropolymerizable materials of the present invention are preferably prepared from homogeneous compositions coated on the selected conductive substrate. Such use of molecular or colloidal solutions ensure the desirable uniform distribution of components throughout the polymerizable mass. Aqueous coating vehicles are preferred due to economy and general lack of hazard.

The availability of numerous types and classes of water-soluble or water-dispersable catalyst precursors, monomers, and binders and adjuncts renders this preference additionally practical. Acid derivatives of amine catalyst precursor components may readily be incorporated in coating compositions as the water-soluble salts, and other forms of diazotizable amine compounds may be included in compositions through the use of water-miscible solvents such as acetone, alcohols and the like. In the latter practice, common coating art precautions are, of course, observed in order to avoid precipitation or coagulation of components.

The following examples are representative of the procedures employed in preparing the electropolymerizable materials of the present invention and the manner of using such materials.

EXAMPLE I

A coating composition was prepared by thoroughly dispersing the following ingredients, generally in the indicated order, in about 135 mls. of deionized water to effect dissolution and a homogeneous mixture:

Gelatin (high bloom, inert) 4.5 g.
Polyvinyl pyrrolidone (med. visc.) 0.75 g.
Acrylamide 2.1 g.
N,N' - methylenebisacrylamide 0.4 g.
Metanilic acid, sodium salt 1.4 g.
Sodium nitrite (10% aq. sol.) 5.5 g.

The resulting mixture was adjusted to a pH of about 8 with 0.1N sodium hydroxide, and 4.5 ml. of ethylene glycol was added to complete the coating composition. A coating of 5 mils wet thickness was applied to the surface of a sand-blasted aluminum sheet of the type commonly employed in the preparation of printing plates and was allowed to dry at room temperature overnight.

A photoconductive cathode was prepared in the known manner by forming a layer of dye-sensitized zinc oxide in a matrix of hardened epoxy resin on the conductive surface of a commercially available electrically-conducting glass panel having a resistivity of about 70 ohms/sq. The layer comprised about one part of binder to 5 parts of zinc oxide sensitized with about 0.1% of a mixture of fluorescein, rose bengal, and bromphenol blue. To provide a practical measure of abrasion resistance, the photoconductive coating was overcoated with a conductive layer comprising about 1 part of carbon black in 3 parts of hardened epoxy resin matrix.

The monomer-containing layer of the imaging sheet was placed in intimate contact with the carbon coating of the photoconductive plate and, with the aluminum carrier of the imaging sheet as anode and the conductive surface of the glass panel as cathode, these two elements were arranged in electrical circuit with a 75-volt DC potential. The glass plate panel of this assembly was then exposed to a projected 15X negative image (500-watt tungsten lamp source) for a period of about 5 seconds. The coated aluminum sheet was then removed from the assembly and the coating was washed in clear, warm water for about one minute during which time portions of the coating corresponding to the unexposed areas of the photoconductor layer were removed from the aluminum carrier sheet. There thus remained, upon the carrier, a good quality, enlarged positive image of the original negative.

EXAMPLE II

An aluminum sheet, as employed in Example I, was coated with a composition identical to the monomer-containing mixture of Example I but for the substitution of 1.0 g. anthranilic acid for the sodium metanilate as the primary amine component. A light exposure of about 10 seconds duration, under the conditions described in Example I and subsequent wash-development, yielded a good quality positive image.

Substitution of a copper-surfaced aluminum sheet and an iron-plated brass sheet, respectively, for the aluminum carrier of the materials in the foregoing examples provided imaging of equally good quality, Utilization of a photoconductive cathode which included a silver-activated cadmium sulfide photoconductor in place of the zinc oxide noted in Example I, resulted in formation of good quality image after an exposure of about 2 seconds, thus confirming the utility of any of the various available photoconductors in the practice of the present invention.

Various of the previously listed primary amines were substituted for the amine components in the foregoing examples with equally good results.

What is claimed is:

1. An electrolytically polymerizable composition comprising:

a. a polymerizable ethylenically unsaturated compound; and
b. a polymerization catalyst precursor comprising a combination of:
   1. an alkali metal nitrite and
   2. a compound selected from the group consisting of diazotizable primary aromatic amines and compounds capable of yielding said amines upon electrolysis.

2. A composition according to claim 1 which includes sufficient alkali to maintain said composition in a normally alkaline condition.

* * * * *